US008519910B2

(12) United States Patent
Park et al.

(10) Patent No.: US 8,519,910 B2
(45) Date of Patent: Aug. 27, 2013

(54) IMAGE PROCESSING METHOD AND DISPLAY DEVICE USING THE SAME

(75) Inventors: Byunghwee Park, Daegu (KR); Namyang Lee, Seongnam-si (KR); Thomas Lloyd Credelle, Morgan Hill, CA (US)

(73) Assignee: LG Display Co., Ltd., Seoul (KR)

( * ) Notice: Subject to any disclaimer, the term of this patent is extended or adjusted under 35 U.S.C. 154(b) by 272 days.

(21) Appl. No.: 12/974,813

(22) Filed: Dec. 21, 2010

(65) Prior Publication Data

US 2011/0285753 A1 Nov. 24, 2011

(30) Foreign Application Priority Data

May 20, 2010 (KR) ..... 10-2010-0047628

(51) Int. Cl.
*G09G 3/16* (2006.01)

(52) U.S. Cl.
USPC ..... 345/48; 345/55; 345/77; 345/84; 313/484; 313/498

(58) Field of Classification Search
USPC ..... 345/690, 12, 20, 63, 72, 77, 83, 88
See application file for complete search history.

(56) References Cited

U.S. PATENT DOCUMENTS

| | | | | |
|---|---|---|---|---|
| 6,801,220 | B2 * | 10/2004 | Greier et al. | 345/694 |
| 7,221,381 | B2 * | 5/2007 | Brown Elliott et al. | 345/690 |
| 8,289,266 | B2 * | 10/2012 | Roth et al. | 345/102 |
| 2003/0085906 | A1 | 5/2003 | Elliott et al. | |

(Continued)

FOREIGN PATENT DOCUMENTS

WO WO 03060870 A1 7/2003

OTHER PUBLICATIONS

Extended European Search Report issued in corresponding European Patent Application No. 10192544.4, mailed Apr. 15, 2011.

*Primary Examiner* — Amare Mengistu
*Assistant Examiner* — Vinh Lam
(74) *Attorney, Agent, or Firm* — Brinks Hofer Gilson & Lione

(57) ABSTRACT

An image processing method comprises: (A) separating R and B data and G data from input data; (B) loading data corresponding to respective odd rows of gamma-converted R and B data, and storing data corresponding to respective even rows of the R and B data adjacent to the loaded odd rows; (C) loading two R data of the even row, along with two R data of the odd row corresponding to a first display position, so as to form a 2×2 R pixel area, and loading two B data of the even row, along with two B data of the odd row corresponding to a second display position, so as to form a 2×2 B pixel area; (D) computing the sharpness of the corresponding display data by comparing the data in each of the R and B pixel areas column by column and row by row; (E) computing the luminance of the display data by taking the average value of the data corresponding to the odd row of each of the R and B pixel areas; (F) determining the gray scale value of output R data by adding the sharpness to the luminance of the R data, and determining the gray scale value of output B data by adding the sharpness to the luminance of the B data; and (G) combining the inverse-gamma-converted R and B data and the input G data and then outputting the combined data according to the sub-pixel structure of the display panel.

14 Claims, 8 Drawing Sheets

(56) References Cited

U.S. PATENT DOCUMENTS

2003/0117423 A1* 6/2003 Brown Elliott et al. ..... 345/690
2005/0088385 A1* 4/2005 Elliott et al. ..... 345/87
2005/0169551 A1* 8/2005 Messing et al. ..... 382/260
2005/0213812 A1* 9/2005 Ishikawa et al. ..... 382/166
2011/0043533 A1* 2/2011 Han et al. ..... 345/589

* cited by examiner $$\begin{bmatrix} 0 & 0.125 & 0 \\ 0.125 & 0.5 & 0.125 \\ 0 & 0.125 & 0 \end{bmatrix}$$

| | | |
|---|---|---|
| Level value | L0 | 4/8 Sharpen |
| | L1 | 3/8 Sharpen |
| | L2 | 2/8 Sharpen |
| | L3 | 1/8 Sharpen |
| Threshold value | T0 | 2047 |
| | T1 | 1023 |
| | T2 | 511 |
| | T3 | 255 |

IMAGE PROCESSING METHOD AND DISPLAY DEVICE USING THE SAME

This application claims the benefit of the Korean Patent Application No. 10-2010-0047628, filed in Korea on May 20, 2010, which are hereby incorporated by reference as if fully set forth herein.

BACKGROUND

1. Field of the Invention

This document relates to an image processing method and a display device using the same.

2. Discussion of the Related Art

Known display devices include a cathode ray tube, a liquid crystal display (LCD), an organic light emitting diode (OLED), a plasma display panel (PDP), etc. Such a display device has as many sub-pixels of red (R), green (G), and blue (B), respectively, as the maximum number of pixels of an image that can be displayed.

In recent years, in order to reduce power consumption and achieve high resolution in a display device, a technology for reproducing an image close to the original image using pixels whose number is smaller than the resolution of an input image was proposed in U.S. Pat. No. 7,492,379, for example.

In this technology, there are as many G sub-pixels as the actual display resolution and as many R and B sub-pixels, respectively, as half the actual display resolution. In other words, as shown in FIG. 1, this technology provides sub-pixel groups, each sub-pixel group comprising eight sub-pixels: four G sub-pixels; two R sub-pixels; and two B sub-pixels, and repeating in a checkerboard pattern. An R sub-pixel and a G sub-pixel constitute one unit pixel, and a B sub-pixel and a G sub-pixel constitute one unit pixel. Input R, G, and B data RGBi is image-processed into data RGBo corresponding to a pixel array of a display device 2 by a sub-pixel rendering block (SPR) 1. At this point, the SPR block 1 renders all input RGB data RGBi.

This technology uses a diamond filter as shown in FIG. 3 to determine gray scale values of sub-pixels using five sub-pixel values. The weighted value of the central portion of the diamond filter is set to 0.5, and the upper, lower, left, and right peripheral portions surrounding the central portion are respectively set to 0.125. As shown in FIG. 4, in order to determine the R data value Ro of a pixel provided at the intersection of an n-th column Cn and an n-th row Rn, a weighted value of 0.5 applies to the R data value Ri of a pixel provided at the intersection of the n-th column Cn and the n-th row Rn, and a weighted value of 0.125 applies to the R data value Ri of a pixel provided at the intersection of the n-th column Cn and an (n−1)-th row Rn−1, the R data value Ri of the pixel provided at the intersection of the n-th column Cn and an (n+1)-th row Rn+1, the R data value Ri of a pixel provided at the intersection of an (n−1)-th column Cn−1 and an n-th row Rn, and the R data value Ri of a pixel provided at the intersection of an (n+1)-th column Cn+1 and the n-th row Rn, respectively. The same method applies to determine G and B data values Go and Bo.

However, in such conventional technology, an algorithm was developed for a display device, which can be actually be manufactured, has a low resolution. A computational process of this algorithm is complicated because R, G, and B data are all filtered to prevent degradation of a display image. As a result, the degree of reduction of power consumption is small in the actual implementation of a driver IC. Moreover, a color error occurs in a display image due to the diamond filter used for image processing and the sharpness processing using G data, and blurring of the contour of the display image occurs as shown in FIG. 5. Further, as is evident in FIG. 4, particular rows and two rows vertically adjacent thereto are required to determine data values of pixels arranged in the corresponding particular rows, so a minimum of three line memories have to be provided. An increase in line memories causes an increase in product unit cost.

BRIEF SUMMARY

One exemplary embodiment of the present invention provides an image processing method, in which three primary color data of an input RGB data format are rendered on a display panel according to a sub-pixel structure of the display panel, the display panel having as many G sub-pixels as the display resolution of input G data and as many R and B sub-pixels as half the display resolution of input R and B data, respectively, the method comprising: (A) separating the R and B data and the G data from the input data; (B) loading data corresponding to respective odd rows of the gamma-converted R and B data, and storing data corresponding to respective even rows of the R and B data adjacent to the loaded odd rows; (C) loading two R data of the even row, along with two R data of the odd row corresponding to a first display position, so as to form a 2×2 R pixel area, and loading two B data of the even row, along with two B data of the odd row corresponding to a second display position, so as to form a 2×2 B pixel area; (D) computing the sharpness of the corresponding display data by comparing the data in each of the R and B pixel areas column by column and row by row; (E) computing the luminance of the display data by taking the average value of the data corresponding to the odd row of each of the R and B pixel areas; (F) determining the gray scale value of output R data by adding the sharpness to the luminance of the R data, and determining the gray scale value of output B data by adding the sharpness to the luminance of the B data; and (G) combining the inverse-gamma-converted R and B data and the input G data and then outputting the combined data according to the sub-pixel structure of the display panel.

One exemplary embodiment of the present invention provides a display device, comprising: a display panel having as many G sub-pixels as the display resolution of input G data and as many R and B sub-pixels as half the display resolution of input R and B data, respectively; a gamma conversion unit for gamma-converting the R and B data separated from input data; a memory for storing data corresponding to respective even rows of the R and B data adjacent to the loaded odd rows line by line when loading data corresponding to respective odd rows of gamma-converted R and B data; a first filtering unit for loading two R data of the even row, along with two R data of the odd row corresponding to a first display position, so as to form a 2×2 R pixel area, loading two B data of the even row, along with two B data of the odd row corresponding to a second display position, so as to form a 2×2 B pixel area, and computing the sharpness of the corresponding display data by comparing the data in each of the R and B pixel areas column by column and row by row; a second filtering unit for computing the luminance of the display data by taking the average value of the data corresponding to the odd row of each of the R and B pixel areas, determining the gray scale value of output R data by adding the sharpness to the luminance of the R data, and determining the gray scale value of output B data by adding the sharpness to the luminance of the B data; an inverse-gamma-conversion unit for inverse-gamma-converting the output R and B data; and a data alignment unit for combining the inverse-gamma-converted R and B data and the input G data and then outputting the combined data according to the sub-pixel structure of the display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE DRAWINGS AND THE PRESENTLY

Preferred Embodiments

Hereinafter, an implementation of this document will be described in detail with reference to FIGS. 6 to 13.

First, an image processing method of the present invention will be described through FIGS. 6 to 11.

Figure 6:
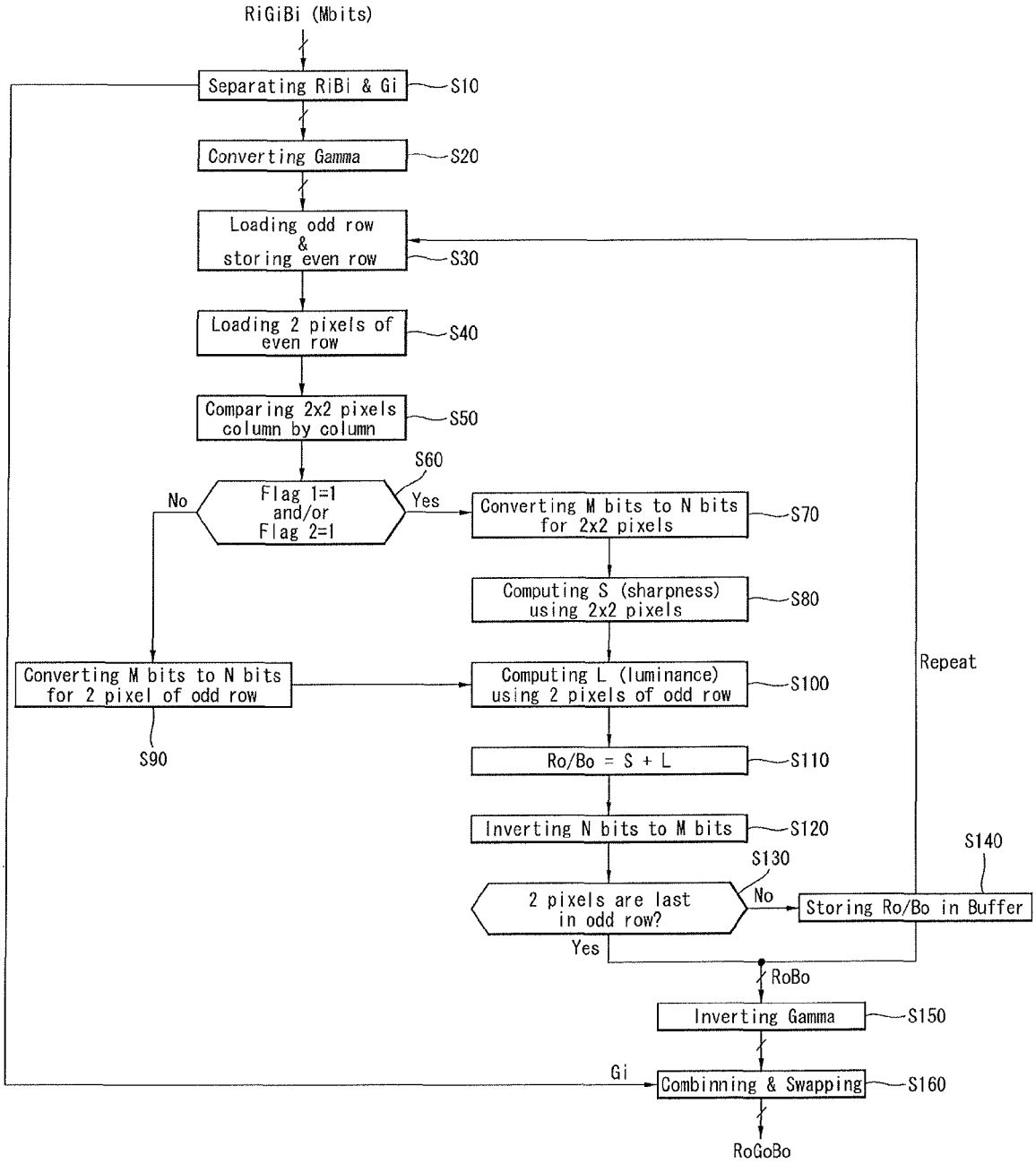
FIG. 6 is a view sequentially showing an image processing method according to an exemplary embodiment of the present invention.

FIG. 6 sequentially shows an image processing method according to an exemplary embodiment of the present invention.

Figure 1:
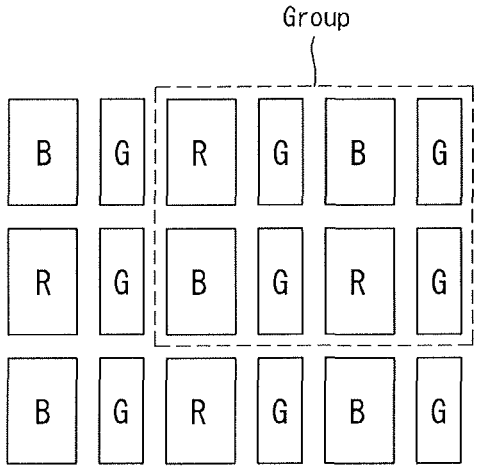
FIG. 1 (RELATED ART)
FIG. 1 is a view showing a conventional pixel configuration.
Figure 2:
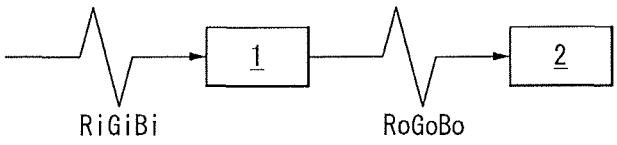
FIG. 2 (RELATED ART)
FIG. 2 is a view schematically showing a configuration for rendering data into a pixel array of FIG. 1.
Figures 3, 4:
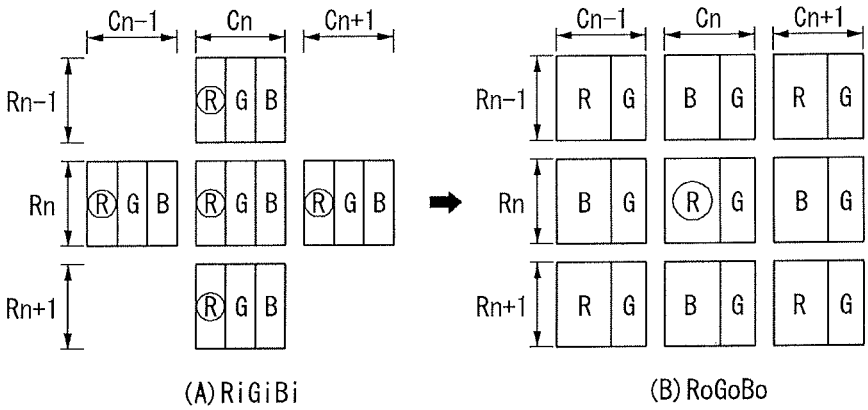
FIG. 3 (RELATED ART)
FIG. 4 (RELATED ART)
FIG. 3 is a view showing a diamond filter used for the rendering of FIG. 2.
FIG. 4 is a view showing one example of rendering.
Figure 5:
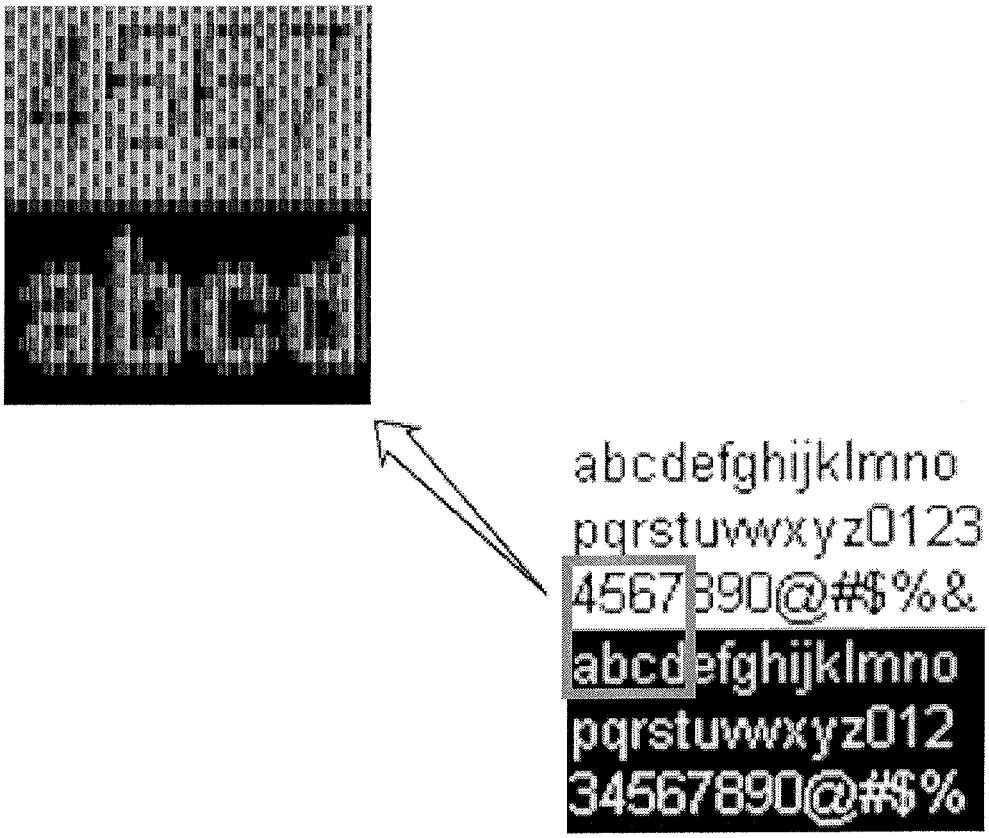
FIG. 5 (RELATED ART)
FIG. 5 is a view showing the blurring of the contour of a display image according to the conventional art.

Referring to FIG. 6, this image processing method is carried out on a display panel whose number of pixels is smaller than the resolution of an input image. In the display panel according to the present invention, there are as many G sub-pixels as the display resolution of input G data and as many R and B sub-pixels as half the display resolution of input R and B data, respectively. In other words, as shown in FIG. 1, the display panel according to the present invention has sub-pixel groups, each sub-pixel group comprising eight sub-pixels: four G sub-pixels; two R sub-pixels; and two B sub-pixels, and repeating in a checkerboard pattern. An R sub-pixel and a G sub-pixel constitute one unit pixel, and a B sub-pixel and a G sub-pixel constitute one unit pixel. In the display panel, a first pixel comprising an R sub-pixel and a G sub-pixel and a second pixel comprising a B sub-pixel and a G sub-pixel are arranged in a checkerboard pattern.

In order to render three primary-color data RiGiBi of an input RGB data format according to a sub-pixel structure of the display panel, in this image processing method, R and B data RiBi and G data Gi are separated from the input data RiGiBi of M bits (M is a natural number) (S10). Then, the separated R and B data RiBi is gamma-converted using any one of preset gamma curves of 1.8 to 2.2 (S20). By this gamma conversion, the R and B data RiBi is converted into a linear value.

In this image processing method, data corresponding to odd rows of the gamma-converted R and B data RiBi is loaded to a register, and data corresponding to even rows of R and B data RiBi adjacent to below the loaded odd rows is stored using one line memory (S30).

Figures 7, 8:
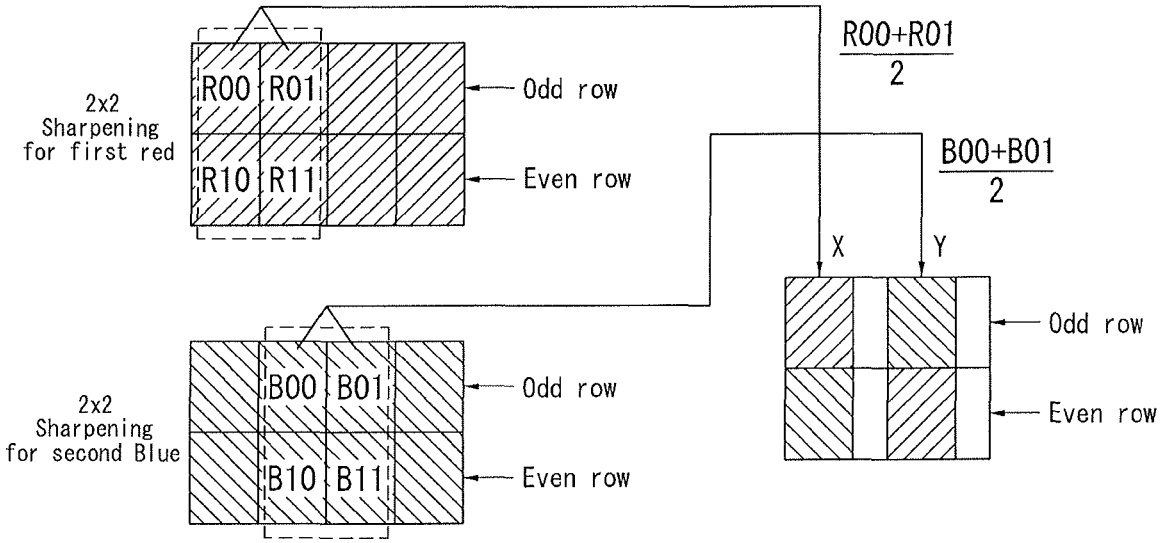
FIG. 7 is a view showing a 2×2 R pixel area and a 2×2 B pixel area.
FIG. 8 is a view illustratively showing a plurality of threshold values and level values.

In this image processing method, as shown in FIG. 7, two R data R10 and R11 of the even row, along with two R data R00 and R01 of the odd row corresponding to a display position X, is loaded to a register so as to form a 2×2 R pixel area. Moreover, two B data B10 and B11 of the even row, along with two B data B00 and B01 of the odd row corresponding to a display position Y, is loaded to the register so as to form a 2×2 B pixel area (S40).

In this image processing method, the logic values of first and second flag bits are determined by comparing the data in each of the R and B pixel areas column by column (S50). In this image processing method, if a comparison value between the data in each column of each of the R and B pixel areas is less than a preset threshold value, the logic values of the flag bits are determined as HIGH ('1'), whereas, if the comparison value is greater than the preset threshold value, the logic values of the flag bits are determined as LOW ('0'). Here, the threshold value may be preset to any one of a plurality of threshold values T0~T3 shown in FIG. 8. For example, in this image processing method, if |R00−R10| in the 2×2 R pixel area is less than the preset threshold value, the logic value of the first flag bit is determined as '1', and if |R01−R11| is less than the preset threshold value, the logic value of the second flag bit is determined as '1'. Moreover, if |B00−B10| in the 2×2 B pixel area is less than the preset threshold value, the logic value of the first flag bit is determined as '1', and if |B01−B11| is less than the preset threshold value, the logic value of the second flag bit is determined as '1'.

In this image processing method, the logic value of at least one of the first and second flag bits is '1' (Yes of S60), the corresponding Rand B pixel areas are detected as a vertical edge for sharpness filtering. And, the number of bits of the data of each of the corresponding R/B pixel area is extended from M bits to N bits (N>M) (S70). Here, 'M' may be '8', and 'N' may be '12'.

In this image processing method, sharpness S is computed using the difference between the data in each row of each of the corresponding R and B pixel areas and a preset level value (S80). The level value may be preset to any one of a plurality of level values L0 to L3 shown in FIG. 8. In the R pixel area, the difference between the data in each row is computed as ⌉even row=R00−R01 and ⌉odd row=R10−R11. Here, '⌉' denotes a mathematical operator indicating ceiling. As a result, the sharpness Sr in the R pixel area is computed by {level value*(⌉even row+odd row/2)}. In the B pixel area, the difference between the data in each row is computed as ⌉-even row=B00−B01 and ⌉odd row=B10−B11. As a result, the sharpness Sb in the B pixel area is computed by {level value*(⌉even row+odd row/2)}.

In this image processing method, if the logic value of the first flag bit and the logic value of the second flat bit are all '0' (No of S60), the number of bits of the data corresponding to the odd row of each of the R and B pixel areas is extended from M bits to N bits without the sharpness processing shown in S70 and S80 (S90).

In this image processing method, considering that the number of pixels of the display panel is half compared to the input image of R and B, the luminance L of display data is computed by taking the average value of the data corresponding to the odd row of each of the R and B pixel areas as shown in FIG. 7 (S100). For example, in FIG. 7, the luminance Lr of R data to be displayed at the X position of the display panel is computed by (R00+R01)/2, and the luminance Lb of B data to be displayed at the Y position of the display panel is computed by (B00+B01)/2. Such a 2×1 simple filtering scheme provides a higher image processing speed because the computation is simplified compared to a conventional diamond filter requiring a complicated computation. Moreover, this scheme is very effective to reduce power consumption since the computation load is reduced.

In this image processing method, the gray scale value of output R data Ro is determined by adding the sharpness Sr to the luminance Lr of the R data, and the gray scale value of output B data Bo is determined by adding the sharpness Sb to the luminance Lb of the B data (S110). And, the number of bits of the output R/B data whose gray scale value is determined is restored from N bits to the original M bits (S120).

In this image processing method, if each of the R and B pixel areas is not the last area of the odd row (No of S130), the gray scale value Ro/Bo of S120 is stored in a buffer and fed back to S30, and then the steps S30 to S120 are repeated until the last area of the odd row. On the contrary, if each of the R and B pixel areas is the last area of the odd row (Yes of S130), all the output R and B data Ro and Bo of the odd rows stored in the buffer are inverse-gamma-converted through the reverse process of S20 (S150).

Figure 9:
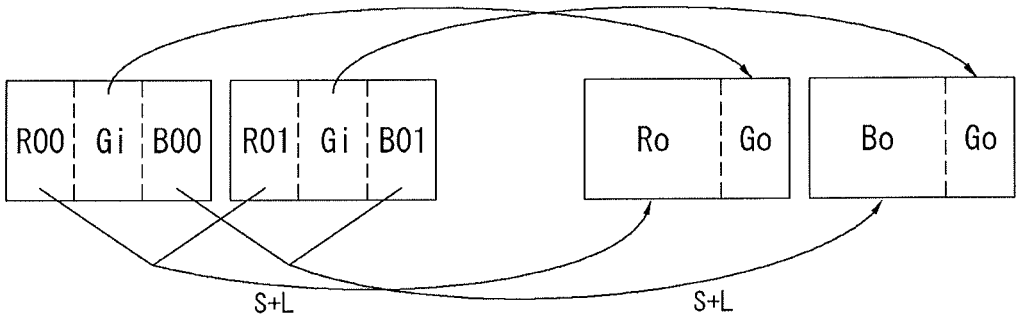
FIG. 9 is a view showing the rearrangement and outputting of output data according to a pixel structure of a display panel.

In this image processing method, the inverse-gamma-converted output R and B data Ro and Bo and the input G data Gi are combined, and then the combined output data RoGoBo is output according to the pixel structure of the display panel as shown in FIG. 9 (S160). The image processing method explained in S10 to S160 is carried out on the data corresponding to all the rows in accordance with a row sequential method.

Figure 10:
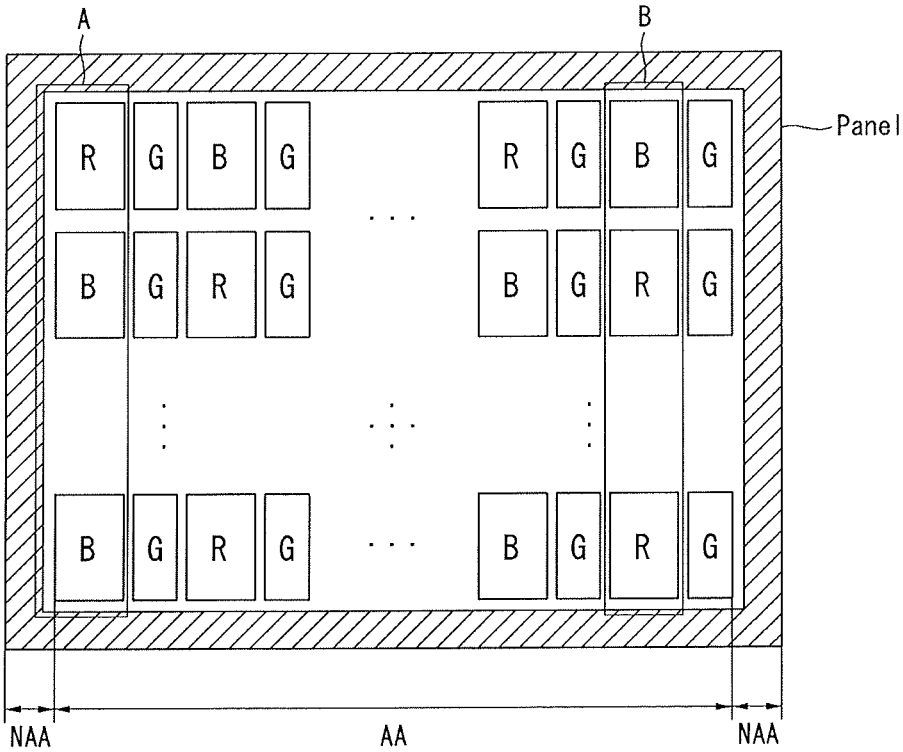
FIG. 10 is a view for explaining a case where a sharpness filtering process is omitted or a level value applied to the sharpness filtering process is set to a maximum value.

Meanwhile, as shown in "A" of FIG. 10, the sharpness filtering process explained in S70 and S80 may be omitted for R and B data columns whose display position is defined between the outermost non-display area NAA of the display panel and a G data column of a display area AA. As sharpness filtering serves to increase luminance, if the sharpness filtering is performed in the "A" position, a purple color produced by mixing the R color and the B color may be recognized as a line in contrast with the non-display area NAA. If the sharpness filtering is skipped for the "A" position, such a side effect is significantly reduced.

Moreover, as for the level value applied to the sharpness filtering process explained in S70 and S80, as shown in "B" of FIG. 10, the maximum level value (e.g., L0 of FIG. 8) can be applied to the R and B data columns whose display position faces the outermost non-display area NAA of the display panel with the G data column interposed therebetween. By thusly reinforcing the sharpness filtering for the R and B data column positioned in "B", a greenish phenomenon caused by the G data column adjoining the outermost non-display area NAA can be greatly alleviated.

Figure 11:
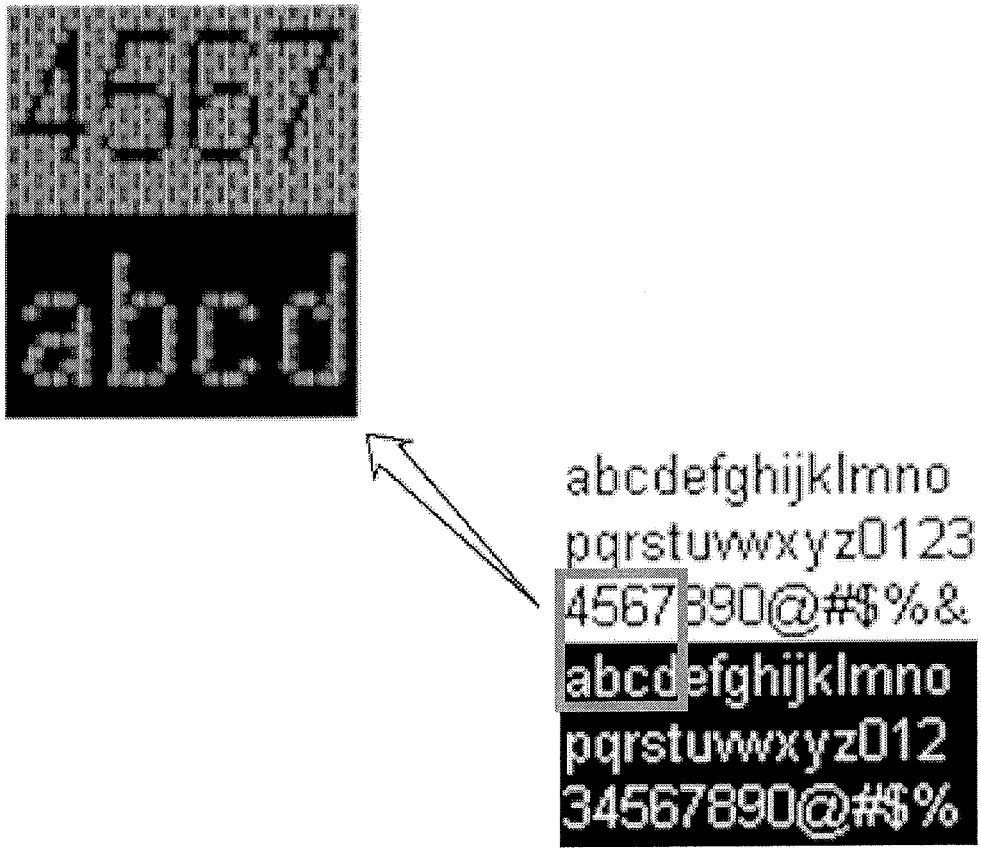
FIG. 11 is a view showing an improvement in display quality level according to the present invention.

As described above, the image processing method according to the exemplary embodiment of the present invention is an algorithm targeting high resolution, in which filtering is only applied to R and B data, but not to G data. Particularly, the 2×1 simple filtering scheme is used for image processing, and no sharpness filtering is performed for G data at all, so power consumption can be reduced. Also, as shown in FIG. 11, the present invention can achieve a display image of a fairly good state without color errors and blurring of the contour of the image. Further, one line memory is sufficient to implement the present invention, unlike the conventional art requiring a minimum of three line memories, thus greatly reducing the product unit cost.

Next, a display device of the present invention will be described through FIGS. 12 and 13.

Figure 12:
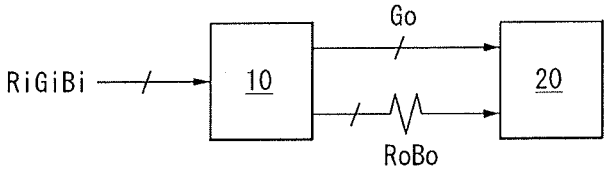
FIG. 12 shows a display device according to an exemplary embodiment of the present invention.

FIG. 12 shows a display device according to an exemplary embodiment of the present invention. FIG. 13 shows an image processing circuit of FIG. 12 in detail.

Referring to FIG. 12, this display device comprises an image processing circuit 10 and a display element 20.

The display element 20 comprises a display panel, a timing controller, a data driver, and a scan driver. This display element 20 can be implemented as a liquid crystal display (LCD), a field emission display (FED), a plasma display panel (PDP), an organic light emitting diode (OLED), etc.

In the display panel, a plurality of data lines and a plurality of gate lines are arranged so as to cross each other, and sub-pixels are formed at the crossings thereof. The number of pixels of the display panel is smaller than the resolution of an input image. In this display panel, there are as many G sub-pixels as the display resolution of input G data and as many R and B sub-pixels as half the display resolution of input R and B data, respectively. In other words, as shown in FIG. 1, the display panel according to the present invention has sub-pixel groups, each sub-pixel group comprising eight sub-pixels: four G sub-pixels; two R sub-pixels; and two B sub-pixels, and repeating in a checkerboard pattern. An R sub-pixel and a G sub-pixel constitute one unit pixel, and a B sub-pixel and a G sub-pixel constitute one unit pixel. In the display panel, a first pixel comprising an R sub-pixel and a G sub-pixel and a second pixel comprising a B sub-pixel and a G sub-pixel are arranged in a checkerboard pattern.

The timing controller receives a plurality of timing signals from a system and generates control signals for controlling the operation timings of the data driver and the scan driver. The control signals for controlling the scan driver include a gate start pulse (GSP), a gate shift clock GSC, a gate output enable signal (GOE), etc. The control signals for controlling the data driver include a source start pulse (SSP), a source sampling clock (SSC), a polarity control signal (POL), a source output enable signal (SOE), etc. The timing controller supplies output R, G, and B data Ro, Go, and Bo from the image processing circuit 10 to the data driver.

The data driver comprises a plurality of source drive integrated circuits (source drive ICs), and latches digital video data RoGoBo under the control of the timing controller. The data driver converts the digital video data RoGoBo into an analog positive/negative data voltage and supplies it to the data lines of the display panel. The number of output channels of the source drive ICs is reduced by ⅓, compared to when R, G, and B sub-pixels are formed into one unit pixel by the above-described sub-pixel configuration of the display panel. As a result, the unit cost of parts can be lowered by chip size reduction.

The scan driver comprises one or more gate drive IC, and sequentially supplies a scan pulse (or gate pulse) to the gate lines of the display panel. In a Gate-In-Panel (GIP) method, the scan driver may comprise a level shifter mounted on a control board and a shift register formed on the display panel.

Figure 13:
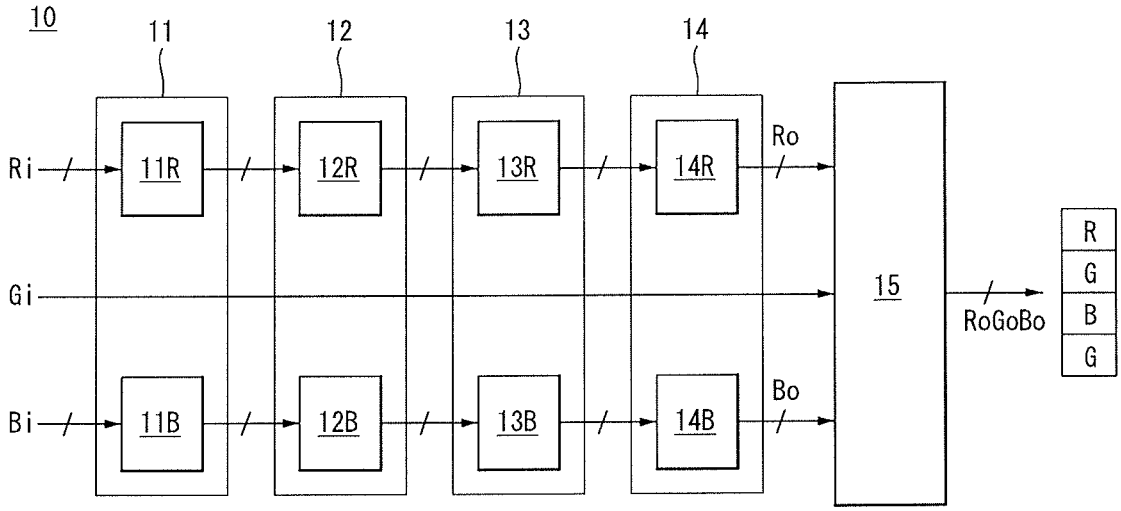
FIG. 13 shows an image processing circuit of FIG. 12 in detail.

The image processing circuit 10 comprises, as shown in FIG. 13, a gamma conversion unit 11, a first filtering unit 12, a second filtering unit 13, an inverse-gamma conversion unit 14, and a data alignment unit 15.

The gamma conversion unit 11 gamma-converts R and B data RiBi separated from input data RiGiBi using any one of preset gamma curves of 1.8 to 2.2, and then supplies it to the first filtering unit 12. The gamma conversion unit 11 comprises an R gamma conversion unit 11R for gamma-converting the R data Ri and a B gamma conversion unit 11B for gamma-converting the B data Bi.

The first filtering unit 12 loads two data of an even row stored in a line memory, along with two data of an odd row corresponding to a corresponding display position is loaded to a register so as to form a 2×2 pixel area. The first filtering unit 12 determines the logic values of first and second flag bits by comparing the data in each of the R and B pixel areas column by column. Thereafter, if the logic value of at least one of the first and second flat bits is '1', the corresponding pixel area is detected as a vertical edge for sharpness filtering. Then, by using the 2×2 pixel area as a sharpness filter, sharpness S is computed using the difference between the data in each row of each of the corresponding pixel areas and a preset level value, and then supplied to the second filtering unit 13. The first filtering unit 12 comprises a first R filtering unit 12R for computing the sharpness of R data Ri and a first B filtering unit 12B for computing the sharpness of B data Bi.

Considering that the number of pixels of the display panel is half compared to the input image of R and B, the second filtering unit 13 computes the luminance L of display data by taking the average value of the data corresponding to the odd row of each of the R and B pixel areas. Such a 2×1 simple filtering scheme provides a higher image processing speed because the computation is simplified compared to a conventional diamond filter requiring a complicated computation. Moreover, this scheme is very effective to reduce power consumption since the computation load is reduced. The second filtering unit 13 determines the gray scale value of output R data Ro by adding sharpness to the luminance of the R data, and determines the gray scale value of output B data Bo by adding sharpness to the luminance of the B data, and then supplies them to the inverse-gamma conversion unit 14. The second filtering unit 13 comprises a second R filtering unit 13R for computing the luminance of display data in the R pixel area and then determining the gray scale value of output R data Ro by adding sharpness to the luminance of the R data and a second B filtering unit 13B for computing the luminance of display data in the B pixel area and then determining the gray scale value of output B data Bo by adding sharpness to the luminance of the B data.

The inverse-gamma conversion unit 14 gamma-converts the output R and B data Ro and Bo and then supplies it to the data alignment unit 15. The inverse-gamma conversion unit 14 comprises an R inverse-gamma conversion unit 14R for inverse-gamma-converting the output R data Ro and a B inverse gamma conversion unit 14B for inverse-gamma-converting the output B data Bo.

The data alignment unit 15 combines the inverse-gamma-converted output R and B data Ro and Bo and the input G data Gi, and then outputs the combined output data according to the pixel structure of the display panel.

As described above, in the image processing method and the display device using the same according to the exemplary embodiment of the present invention, the 2×1 simple filtering scheme is used for R and B data for image processing, and no sharpness filtering is performed for G data at all, so power consumption can be reduced and display quality level can be greatly improved. Further, one line memory is sufficient to implement the image processing method and the display device using the same according to the present invention, unlike the conventional art requiring a minimum of three line memories, thus greatly reducing the product unit cost.

Further, exemplary embodiments of the present invention have been described, which should be considered as illustrative, and various changes and modifications can be made without departing from the technical spirit of the present invention. Accordingly, the scope of the present invention should not be limited by the exemplary embodiments, but should be defined by the appended claims and equivalents.

The invention claimed is:

1. An image processing method, in which three primary color data of an input RGB data format are rendered on a display panel according to a sub-pixel structure of the display panel, the display panel having as many G sub-pixels as a display resolution of the input G data and as many R and B sub-pixels as half a display resolution of the input R and B data, respectively, the method comprising:

(A) separating the R and B data and the G data from the input data;

(B) loading data corresponding to respective odd rows of gamma-converted R and B data, and storing data corresponding to respective even rows of the R and B data adjacent to the loaded odd rows;

(C) loading two R data of the even row, along with two R data of the odd row corresponding to a first display position, so as to form a 2×2 R pixel area, and loading two B data of the even row, along with two B data of the odd row corresponding to a second display position, so as to form a 2×2 B pixel area;

(D) computing a sharpness of the corresponding display data by comparing the data in each of the R and B pixel areas column by column and row by row;

(E) computing a luminance of the display data by taking an average value of the data corresponding to the odd row of each of the R and B pixel areas;

(F) determining a gray scale value of output R data by adding the sharpness to the luminance of the R data, and determining a gray scale value of output B data by adding the sharpness to the luminance of the B data; and (G) combining the inverse-gamma-converted R and B data and the input G data and then outputting the combined data according to the sub-pixel structure of the display panel.

2. The method of claim 1, wherein the (D) comprises:

(D1) determining a logic values of first and second flag bits by comparing the data in each of the R and B pixel areas column by column with reference to a preset threshold value; and (D2) computing the sharpness of the corresponding display data using a difference between the data in each row of each of the R and B pixel areas and a preset level value based on the logic values of the first and second flag bits.

3. The method of claim 2, wherein, in (D1), if a comparison value between the data in each column is less than the preset threshold value, the logic values of the first and second flag bits are determined as HIGH, whereas, if the comparison value is greater than the preset threshold value, the logic values of the first and second flag bits are determined as LOW; and, in (D2), if the logic value of at least one of the first and second flag bits is HIGH, the corresponding R and B pixel areas are detected as a vertical edge for sharpness filtering, and then the number of bits of the data of the corresponding R/B pixel area is extended from M bits to N bits (N>M).

4. The method of claim 3, further comprising:

if the logic values of the first and second flag bits are all LOW, extending the number of bits of the data corresponding to the odd row of each of the R and B pixel areas from M bits to N bits between (D) and (E); and restoring the number of bits of the output R/B data whose gray scale value is determined from N bits to M bits between (F) and (G).

5. The method of claim 1, further comprising:

gamma-converting the separated R and B data between (A) and (B); and inverse-gamma-converting the output R and B data between (F) and (G).

6. The method of claim 2, wherein the sharpness is obtained by dividing a sum of the differences between the data in each row of each of the R and B pixel areas by 2 and multiplying the preset level value to a dividing result.

7. The method of claim 1, wherein, in the display panel, a first pixel comprising an R sub-pixel and a G sub-pixel and a second pixel comprising a B sub-pixel and a G sub-pixel are arranged in a checkerboard pattern; and the (D) is omitted for R and B data columns whose display position is defined between the outermost non-display area of the display panel and a G data column.

8. The method of claim 7, wherein, in the (D), a maximum level value is applied to the R and B data columns whose display position faces the outermost non-display area of the display panel with the G data column interposed therebetween.

9. A display device, comprising:

a display panel having as many G sub-pixels as a display resolution of input G data and as many R and B sub-pixels as half a display resolution of input R and B data, respectively;

a gamma conversion unit for gamma-converting the R and B data separated from the input data;

a register for loading data corresponding to respective odd rows of the gamma-converted R and B data;

a memory for storing data corresponding to respective even rows of the R and B data adjacent to a loaded odd rows line by line;

a first filtering unit for loading two R data of the even row, along with two R data of the odd row corresponding to a first display position, so as to form a 2×2 R pixel area, loading two B data of the even row, along with two B data of the odd row corresponding to a second display position, so as to form a 2×2 B pixel area, and computing a sharpness of the corresponding display data by comparing the data in each of the R and B pixel areas column by column and row by row;

a second filtering unit for computing a luminance of the display data by taking an average value of the data corresponding to the odd row of each of the R and B pixel areas, determining a gray scale value of output R data by adding the sharpness to the luminance of the R data, and determining a gray scale value of output B data by adding the sharpness to the luminance of the B data;

an inverse-gamma-conversion unit for inverse-gamma-converting the output R and B data; and a data alignment unit for combining the inverse-gamma-converted R and B data and the input G data and then outputting a combined data according to the sub-pixel structure of the display panel.

10. The display device of claim 9, wherein the first filtering unit determines a logic values of first and second flag bits by comparing the data in each of the R and B pixel areas column by column with reference to a preset threshold value; and computes the sharpness of the corresponding display data using a difference between the data in each row of each of the R and B pixel areas and a preset level value based on the logic values of the first and second flag bits.

11. The display device of claim 10, wherein, if a comparison value between the data in each column is less than the preset threshold value, the first filtering unit determines the logic values of the first and second flag bits as HIGH, whereas, if the comparison value is greater than the preset threshold value, the first filtering unit determines the logic values of the first and second flag bits as LOW; and if the logic value of at least one of the first and second flag bits is HIGH, the corresponding R and B pixel areas are detected as a vertical edge for sharpness filtering.

12. The display device of claim 10, wherein the sharpness is obtained by dividing a sum of the differences between the data in each row of each of the R and B pixel areas by 2 and multiplying the preset level value to a dividing result.

13. The display device of claim 9, wherein, in the display panel, a first pixel comprising an R sub-pixel and a G sub-pixel and a second pixel comprising a B sub-pixel and a G sub-pixel are arranged in a checkerboard pattern; and the first filtering unit skips the computation of the sharpness for R and B data columns whose display position is defined between an outermost non-display area of the display panel and a G data column.

14. The display device of claim 13, wherein the first filtering unit applies a maximum level value to the R and B data columns whose display position faces the outermost non-display area of the display panel with a G data column interposed therebetween.

* * * * *